United States Patent [19]

Clark, Jr.

[11] 4,418,547

[45] Dec. 6, 1983

[54] THERMALLY POWERED HEAT TRANSFER SYSTEMS

[75] Inventor: Robert W. Clark, Jr., Phoenix, Ariz.

[73] Assignee: The Saint E. Company, Inc., Phoenix, Ariz.

[21] Appl. No.: 413,095

[22] Filed: Aug. 30, 1982

Related U.S. Application Data

[63] Continuation-in-part of Ser. No. 214,458, Dec. 8, 1980, abandoned.

[51] Int. Cl.[3] ..... F25B 1/00

[52] U.S. Cl. ..... 62/116; 62/333; 62/335; 62/467 R

[58] Field of Search ..... 62/116, 333, 335, 467 R, 62/500, 510

[56] References Cited

U.S. PATENT DOCUMENTS

| | | | |
|---|---|---|---|
| 3,577,880 | 5/1971 | Leslie | 62/86 |
| 3,699,779 | 10/1972 | Schlichtig | 62/467 R |
| 3,823,573 | 7/1974 | Cassady | 62/467 R |
| 4,281,969 | 8/1981 | Doub, Jr. | 62/510 |

*Primary Examiner*—Ronald C. Capossela

[57] ABSTRACT

A thermally powered heat transfer system consisting of two closed heat transfer loops which share a compressor which is alternately powered by the refrigerants of the two loops. This system is powered by two heat sources having different temperatures of which the lower temperature heat source may be the heat within a structure to be cooled. An evaporator of the first loop located within the structure to be cooled is charged with a low boiling point refrigerant while an evaporator of the second loop is heated by a higher temperature heat source and is charged with a higher boiling point refrigerant. The heat sinks of the loops are at temperatures between those of the two heat sources. Controls are activated at the completion of each compressor stroke, or cycle, to alternately open and close valves which regulate vapor and liquid flows to cause the compressor to act with compressive force upon one or the other refrigerant vapor during each cycle of operation of the system to effect useful heat transfer.

14 Claims, 3 Drawing Figures

THERMALLY POWERED HEAT TRANSFER SYSTEMS

CROSS REFERENCE TO RELATED APPLICATION

This application is a continuation-in-part of application Ser. No. 06/214,458 filed Dec. 8, 1980 now abandoned.

BACKGROUND OF THE INVENTION

1. Field of the Invention

This invention is in the field of thermally powered heat transfer systems, and more particularly relates to refrigeration systems which use heat to cool a structure. This invention incorporates a new general method of using heat to accomplish the cooling of a structure in that the invention actively utilizes two different heat sources having different temperatures, of which at least the lower temperature heat source is within the structure to be cooled, and in that it employs a new type of compressor capable of acting with positive compressive force in both of two possible compressive action directions. This new general method and this invention are of major significance in this era of energy shortages because they permit relatively small temperature differences to be made useful in accomplishing the cooling of structures.

2. Description of the Prior Art

Previous inventions in the field of thermally powered refrigeration systems used one of two general methods to cool a structure. One of these general methods, known as the absorption cycle, is dependent upon a refrigerant being soluble in an absorbent and upon that refrigerant being more soluble in that absorbent when pressure is increased, the increase in pressure being produced by heat from some heat source. For efficient operation absorption cycle systems require a temperature of at least 200° F. The general method used in the current invention is not related to the absorption cycle.

The second general method used in the field of thermally powered refrigeration systems involves the use of a single, external heat source and various means of converting thermal energy into mechanical energy which is then transmitted by some means in a manner which drives the compressor of a traditional compressor cycle refrigeration system. For efficient operation such systems require a temperature of at least 165° F. The general method used in the current invention is only superficially related to such systems in that this invention, as do existing systems, uses an external heat source to vaporize a refrigerant and uses two heat transfer units which function as evaporators and two heat transfer units which function as condensers. Also, both existing systems and the current invention employ compressors but the design and method of operation of the new type of compressor employed in the current invention differs greatly from the design and method of operation of existing compressors used in existing systems. The current invention uses two heat sources rather than one to power the compressor and the high temperature, external heat source need not have a temperature higher than 115° F.

SUMMARY OF THE INVENTION

The present invention provides a thermally powered heat transfer system particularly adapted to the cooling of a home or other structure. The system has an evaporator located within the structure to be cooled, two condensers located within a natural or created heat sink having a temperature normally higher than the temperature of the structure to be cooled, a second evaporator located within an external heat source having a temperature always higher than the temperature of the heat sink, and a two cylinder or two chamber compressor with a free piston or flexible dividing member, or diaphragm, capable of acting with positive compressive force in both of two possible compressive action directions. These evaporators, condensers and compressor are joined with the necessary piping and electrically activated valves to form two closed loop heat transfer systems. One closed loop includes the evaporator located within the structure to be cooled, one of the two condensers, and the first cylinder or first chamber of the compressor and this closed loop is filled with a first refrigerant. The second closed loop includes the second evaporator, the second condenser and the second cylinder or chamber of the compressor and this closed loop is filled with a second refrigerant having a higher boiling point at atmospheric pressure than the first refrigerant contained in the first closed loop. The compressor is constructed so that the two refrigerants are kept separate. The refrigerants are selected on the basis of their thermodynamic properties in relation to each other and system design parameters so that when vapor formed in the evaporator located in the structure to be cooled is permitted to flow into the first compressor cylinder or chamber, it causes the compressor piston or dividing member to act with positive compressive force upon the second refrigerant vapor in the second compressor cylinder or chamber and likewise when vapor formed in the second evaporator located within the higher temperature heat source is allowed to flow into the second compressor cylinder or chamber it in turn causes the second compressor piston to act with compressive force upon the first refrigerant vapor in the first compressor cylinder or chamber. These flows are controlled or regulated by electrically activated valves controlled by switches which are activated by the common piston of the two cylinders of the compressor at the completion of each piston stroke which corresponds to the completion of a cycle of operation of the system. Two heat sources, one of which is the structure to be cooled, are thus employed to effect the cooling of that structure. This invention permits the second, external heat source to have a relatively low temperature in comparison to the temperature of a single heat source required for the operation of other thermally powered refrigeration systems and permits relatively low temperature heat sources to be substituted for electric power or fuels in comfort air conditioning and other refrigeration systems.

It is therefore an object of this invention to provide a thermally powered heat transfer system which can be used for the cooling of homes and other structures.

It is still another object of this invention to provide a new general method for the design of thermally powered heat transfer systems in which two heat sources, one of which is the structure to be cooled, are actively utilized to effect the cooling of homes and other structures.

It is still another object of this invention to provide a thermally powered refrigeration system which can be operated at low purchased energy cost.

It is still another object of this invention to provide a new and useful compressor capable of positive compressive action in both of two possible compressive action directions.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
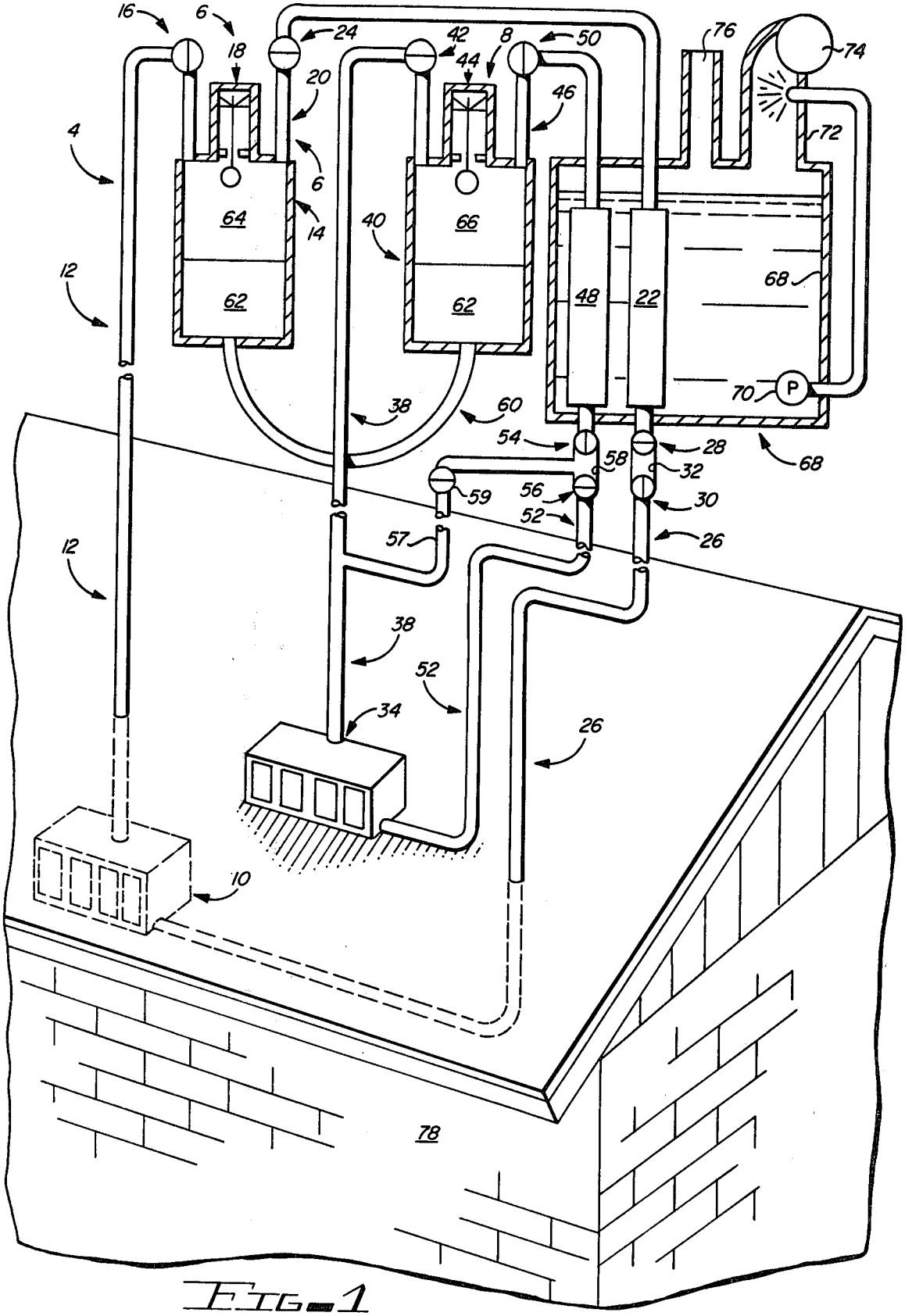
FIG. 1 is a schematic view of a preferred embodiment of the thermally powered refrigeration system embodying this invention.

The thermally powered refrigeration system 4 depicted in FIG. 1 consists of two closed heat transfer loops 6,8 each of which contains a refrigerant in both liquid and vapor states. Closed loop 6 consists of one or more evaporators, or heat exchangers, 10 located within the air space or an air duct of the structure 78 to be cooled and through which evaporator 10 air is circulated. The top of evaporator 10 is connected by means of refrigerant vapor pipe 12 to the top of cylinder 14. Vapor flow through refrigerant vapor pipe 12 is regulated by electrically activated valve 16. A float controlled switch 18 is located at the top of cylinder 14. Refrigerant vapor pipe 20 connects the top of cylinder 14 to the top of condenser 22, vapor flow through refrigerant vapor pipe 20 being regulated by electrically activated valve 24. The bottom of condenser 22 is connected to the bottom of evaporator 10 by means of refrigerant liquid pipe 26, liquid flow through refrigerant liquid pipe 26 is regulated or controlled by electrically activated valves 28 and 30. The segment of refrigerant liquid pipe 26 between valves 28 and 30 is larger in diameter than the balance of this pipe and form first liquid refrigerant collector 32.

Closed heat transfer loop 8 consists of an evaporator or heat exchanger, 34 located so as to acquire heat from an external heat source, said evaporator 34 being depicted in FIG. 1 as a solar collector on the roof of structure 78 deriving heat from solar energy. The top of evaporator 34 is connected by means of refrigerant vapor pipe 38 to the top of cylinder 40. Vapor flow through refrigerant vapor pipe 38 is regulated by electrically activated valve 42. A float controlled switch 44 is located at the top of cylinder 40. Refrigerant vapor pipe 46 connects the top of cylinder 40 to the top of condenser 48, vapor flow through refrigerant vapor pipe 46 is regulated by electrically activated valve 50. The bottom of condenser 48 is connected to the bottom of evaporator 34 by means of refrigerant liquid pipe 52, liquid flow through refrigerant liquid pipe 52 being regulated by electrically activated valves 54 and 56. The segment of refrigerant liquid pipe 52 between valves 54 and 56 is larger in diameter than the balance of this pipe and forms second liquid refrigerant collector 58. Refrigerant vapor pipe 38 is connected to the upper portion of refrigerant collector 58 by vapor pipe 57. Flow of vapor through pipe 57 to collector 58 is controlled by electrically activated valve 59. Vapor pipe 57 and valve 59 permit vaporized refrigerant in vapor pipe 38 to flow into collector 58 to facilitate the relatively rapid flow of liquified refrigerant from collector 58 to evaporator 34 through pipe 52 when valve 56 is opened and valve 54 is closed.

Piston liquid pipe 60 connects the bottom of cylinder 14 to the bottom of cylinder 40 in such a manner that the piston liquid 62 is free to move from one cylinder to the other and back and thus constitutes a free piston. Piston 62 moves in cylinders 14 and 40 in response to changes in the vapor pressures exerted upon the surface areas of piston liquid 62 by the first refrigerants 64 and the second 66 within cylinders 14, 40 during the two cycles of operation of system 4 which cycles of operation are controlled by the conditions of electrically activated valves 16, 24, 28, 30 of first loop 6 and valves 42, 50, 54, and 56 of second loop 8. Piston liquid 62 prevents the passage of first refrigerant 64 from closed loop 6 to the closed loop 8 containing second refrigerant 66. It is necessary that the two refrigerants 64 and 66 be essentially insoluble in piston liquid 62.

Condenser 22 and condenser 48 are both depicted in FIG. 1 as being submerged in water contained in water tank 68, this water being evaporatively cooled continuously by being pumped by pump 70 from the tank to the top of water tower 72 through which air is blown by blower 74, the air being exhausted through air vent 76. The evaporatively cooled water serves as the heat sink for both closed loops 6, 8 as depicted in FIG. 1 but it is not necessary to the spirit of this invention that all heat sinks be evaporatively cooled.

Cylinder 14 and cylinder 40 are each initially slightly more than half full of piston liquid 62 and piston liquid pipe 60 is completely full of piston liquid 62. Water or mercury may be used as piston liquid 62 with water being preferred since the refrigerants chosen are essentially insoluable in water.

Each of closed heat transfer loops 6, 8 is charged with a different refrigerant. Closed loop 6 which utilizes the heat within the structure 78 as its heat source, is charged with refrigerant 64 that has a lower boiling point at atmospheric pressure than the refrigerant 66 with which closed loop 8 is charged. It is required that the vapor pressure of the refrigerant 64 be higher at the temperature of its vaporization by the low temperature heat source, structure 78, than the vapor pressure of refrigerant 66 at the temperature of its condensation within condenser 48. It is equally necessary that the vapor pressure of refrigerant 66 be higher at the temperature of its vaporization by high temperature external heat source 34 than the vapor pressure of the refrigerant 64 at the temperature of its condensation within condenser 22. In both closed loops 6 and 8 refrigerants 64 or 66 are introduced until the liqid refrigerant levels reach the tops of evaporators 10 or 34.

To illustrate the operation of this invention let us now assume that the refrigerant 64 with which the first closed loop system is charged is refrigerant R 22, chlorodifluoromethane, having a boiling point at atmospheric pressure of $-41.4°$ F. Let us also assume that the refrigerant 66 with which the second closed loop system is charged is refrigerant R 12, dichlorodifluoromethane, having a boiling point at atmospheric pressure of −21.6° F. Let us also assume that the temperature of the heat sink, the water within water tank 68, is such that a temperature of 75° F. is maintained within condensers 22 and 48 for both refrigerants. Let us also assume that the temperature of the air within structure 78 and air flow through evaporator 10 is such that the temperature of the refrigerant 64 (R22) temperature within evaporator 10 is 60° F. Let us also assume that solar heat input into evaporator 34 is such that the temperature of the refrigerant 66 (R 12) within evaporator 34 is maintained at a temperature higher than 108° F. and for this specific example let us assume that the refrigerant 66 (R12) temperature within the evaporator 34 is 110° F. Let us also assume that the cylinders 14 and 40 are initially slightly more than half full of piston liquid 62 and that piston liquid pipe 60 is completely full of piston liquid 62, and finally let us assume that valves 16, 30, and 50 and 54 are initially open and that valves 24, 28, 42, 56 and 59 are closed which defines the statues of these valves during the first cycle of operation of system 4.

During the first cycle of operation the portion of cylinder 40 that is filled with vapor is isolated from evaporator 34 by closed valve 42 but not from condenser 48 since valve 50 is open Thus, the refrigerant 66 (R12) vapor within the vapor filled portion of cylinder 40 is free to flow or may be caused to flow to condenser 48 whenever the refrigerant 66 (R12) vapor within cylinder 40 has a vapor pressure that exceeds 91.682 PSIA, the pressure at which refrigerant 66 (R12) vapor condenses at the internal condenser 48 temperature of 75° F. Refrigerant 66 (R12) vapor which condenses in condenser 48 flows by force of gravity into second refrigerant collector 58 through open valve 54 where it collects since valve 56 and valve 59 are closed.

During a first cycle of operations of system 4 evaporator 10 is connected to the vapor filled portion of cylinder 14 by means of refrigerant vapor pipe 12 and open valve 16 but the vapor filled portion of cylinder 14 is isolated from condenser 22 by closed valve 24. Thus the refrigerant 64 (R22) vapor which forms in evaporator 10 at a vapor pressure of 116.31 PDIA when its temperature is the specified 60° F. is free to flow into the vapor filled portion of cylinder 14 whenever the vapor filled portion of cylinder 14 has a vapor pressure of less than 116.31 PSIA or the vapor pressure within the vapor filled portion of cylinder 40 is less than 116.31 PSIA, the latter conditions being accompanied by the flow of piston liquid 62 from cylinder 14 to cylinder 40 through piston liquid pipe 60.

Under these conditions, therefore, the refrigerant 64 (R 22) vapor exerts a pressure of approximately 116.31 PSIA upon the surface of the piston liquid 62 in cylinder 14 while at the same time the refrigerant 66 (R 12) vapor exerts a pressure of approximately 91.682 PSIA upon the surface of the piston liquid 62 in cylinder 40. Consequently, in response to this difference in pressure, refrigerant 64 (R 22) vapor forms in the evaporator 10 and flows into cylinder 14 forcing the piston liquid 62 to flow from cylinder 14 into cylinder 40 and thereby forcing in turn the flow of refrigerant 66 (R 12) vapor from cylinder 40 into condenser 48 under a pressure greater than 91.682 PSIA, thereby causing the condensation of the refrigerant 66 (R 12) vapor in condenser 48. These flows continue until the piston liquid 62 level in cylinder 40 reaches float controlled switch 44 and causes float controlled switch 44 to rise, thereby activating float controlled switch 44.

Activation of float controlled switch 44 terminates a first cycle of operation of system 4 and initiates a second by causing electrically activated valves 16, 30, 50 and 54 to close and all closed electrically activated valves 24, 28, 42, 56 and 59 to open. When this reversal of valve positions occurs the large vapor filled portion of cylinder 14 becomes isolated from the evaporator 10 by the closing of valve 16 and becomes connected to condenser 22 via refrigerant vapor pipe 20 and the now open valve 24. The closing of valve 30 and the opening of valve 28 prepares the way for the flow of the liquid refrigerant 64 (R22) from condenser 22 into collector 32 through open valve 28 while isolating condenser 22 from the evaporator 10.

At the same time the reversal of valve positions isolates the small vapor filled portion of cylinder 40 from condenser 48 by the closing of valve 50, and connects this portion of cylinder 40 to evaporator 34 via refrigerant vapor pipe 38 and the now open valve 42. The closing of valve 54 and the opening of valves 56 and 59 permit the liquid refrigerant 66 (R12) that was in collector 58 to flow by force of gravity through liquid refrigerant pipe 52 into evaporator 34 while isolating condenser 48 from evaporator 34.

Refrigerant 64 (R22) vapor that fills the vapor filled portion of cylinder 14 during a second cycle of operation of cycle 4 exerts a pressure of approximately 116.31 PSIA upon the surface of piston liquid 62 in cylinder 14. Refrigerant 66 (R12) vapor which forms in evaporator 34 at a temperature of 110° F. has a vapor pressure of 151.11 PSIA. Since refrigerant 66 (R12) vapor is now free to flow from evaporator 34 to cylinder 40 via refrigerant vapor pipe 38 and open valve 42, refrigerant 66 (R12) vapor exerts a pressure of approximately 151.11 PSIA upon the surface of piston liquid 62 in cylinder 40. As a consequence of the pressure differences, refrigerant 66 (R12) vapor forms in evaporator 34 and flows into cylinder 40 forcing piston liquid 62 out of cylinder 40 and into cylinder 14, thereby exerting a compressive force upon the refrigerant 64 (R22) vapor. The compressive force exerted upon the refrigerant 64 (R22) vapor in cylinder 14 causes its temperature to rise above 75° F. and its vapor pressure to rise above 146.91 PSIA and causes the refrigerant 64 (R22) vapor to flow from cylinder 14 into condenser 22 where at that pressure and temperature the vapor condenses. The liquid refrigerant 64 (R22) flows by force of gravity from condenser 22 into collector 32 between valves 28 and 30. These flows continue until the level of piston liquid 62 in cylinder 14 reaches float controlled switch 18. The activation of float controlled switch 18 causes all open electrically activated valves 24, 28, 42, 56 and 59 to close and all closed electrically activated valves 16, 30, 50, and 54 to open, which terminates the second cycle of operation of system 4 and initiates a first cycle.

Given a condensing temperature of 75° F., the cycle will continue to repeat in this manner so long as the temperature of the refrigerant 64 (R22) within evaporator 10 exceeds a minimum temperature of 46° F. and so long as the temperature of the refrigerant 66 (R12) within evaporator 34 exceeds a minimum temperature of 108° F. Cycle speed increases as temperatures exceed these minimums. Minimum temperatures change whenever the condensing temperature changes, rising when the condensing temperature rises and falling when the condensing temperature falls. Various refrigerant pairs other than the pair consisting of refrigerant R22 and refrigerant R12 may be selected to match desired system performance in terms of the temperature desired within the structure to be cooled and total cooling capacity to the available heat sink temperature and to the available external heat source temperature. The thermodynamic properties of the two refrigerants selected must be such that the lower boiling point refrigerant exerts a higher vapor pressure at the temperature of its vaporization by the low temperature heat source than the higher boiling point refrigerant exerts at the temperature of its condensation by the heat sink and such that the higher boiling point refrigerant exerts a higher vapor pressure at the temperature of its vaporization by the high temperature heat source than the lower boiling point refrigerant exerts at the temperature of its condensation by the heat sink. Both of the refrigerants must be essentially insoluble in the piston liquid if the compressor utilizes a liquid piston. Such alternate refrigerant pairs may be selected without departing from the spirit of the invention as defined by the scope of the appended claims.

The invention as depicted in FIG. 1 and as it has so far been described produces alternate vapor flows from the two evaporators 10 and 34 to the two cylinders 14 and 40 and from cylinders 14 and 40 to the two condensers 22 and 48. Each of the two closed loop heat transfer systems could consists of more than one evaporator or more than one condenser without any modification of these alternate flows and without departing from the spirit of the invention as defined by the scope of the appended claims. The utilization of more than one compressor in conjunction with additional valves would permit continuous flow of vapor from a given evaporator to one or the other compressor and from one or the other compressor to a given condenser and this change could be made without departing from the spirit of the invention as defined by the scope of the appended claims.

Figure 2:
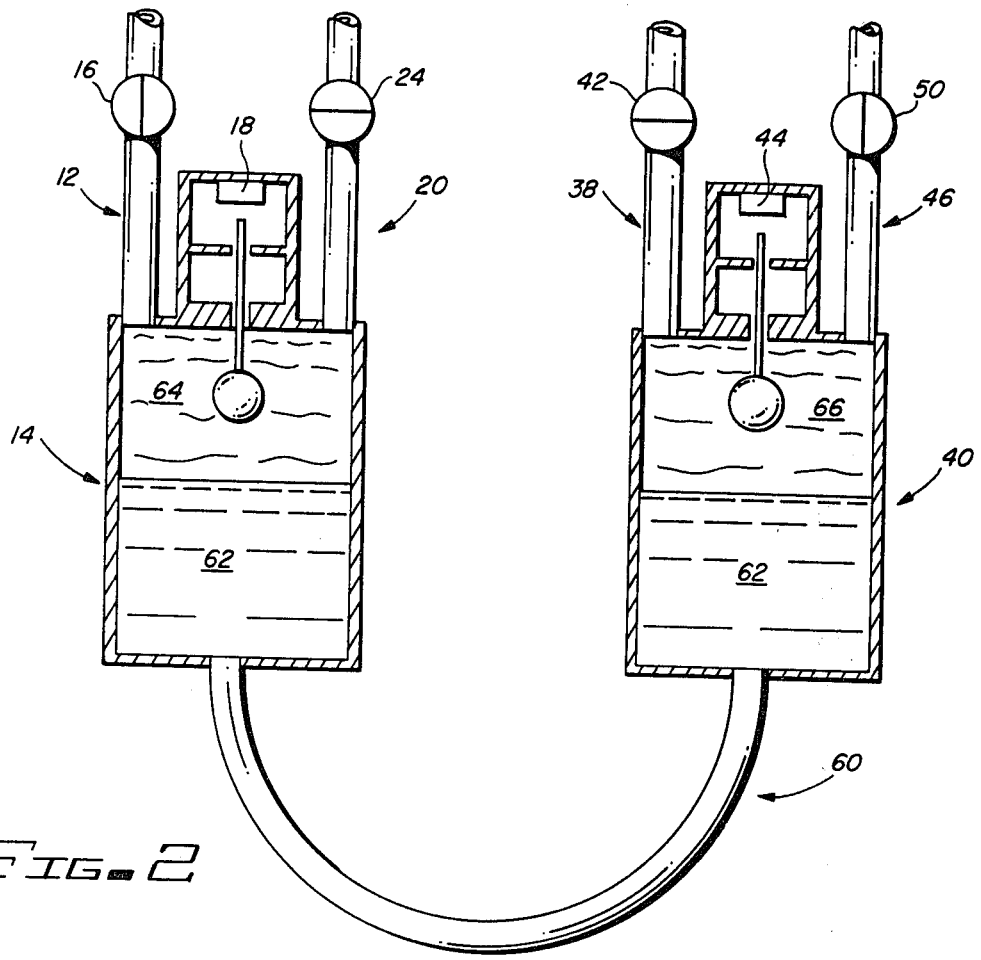
FIG. 2 is a schematic sectional view of a preferred embodiment of the compressor capable of compressive action in both of two possible compressive action directions in which the piston is a liquid.
Figure 3:
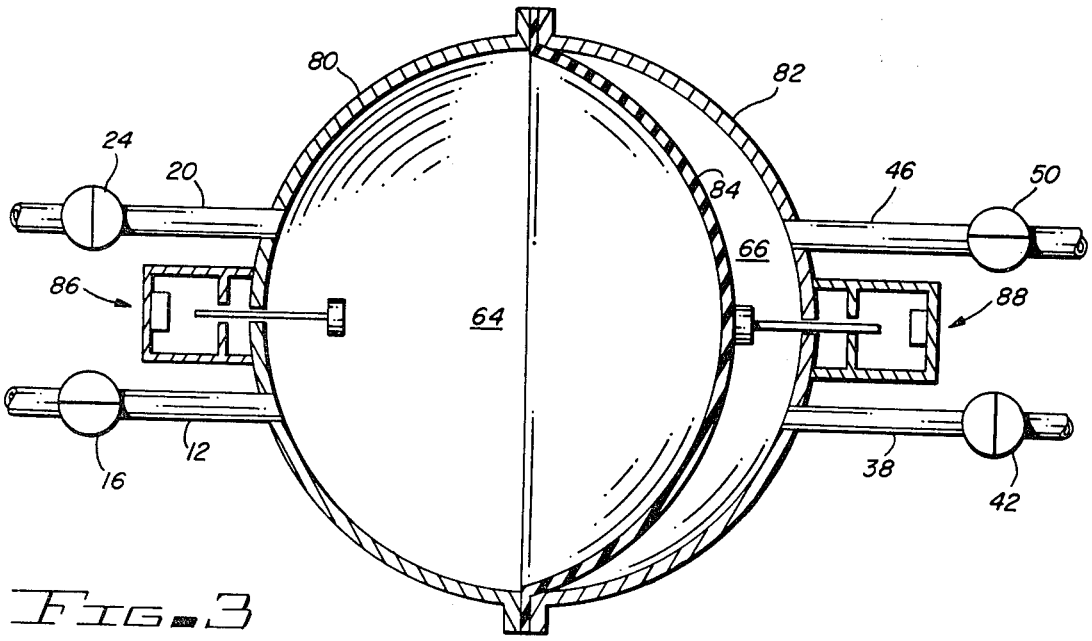
FIG. 3 is a schematic sectional view issued as an alternative design of the compressor more suitable for use at very low temperatures in which a shaped membrane replaces the liquid piston.

FIG. 2 depicts a liquid free piston compressor capable of compressive action in both of two possible compressive action directions. FIG. 3 illustrates an alternative compressor design, also capable of compressive action in both of the two possible compressive action directions, which may be more suitable than the liquid piston compressor when very low temperatures are desired. In this alternative design cylinder 14 is replaced with hemisphere 80 and cylinder 40 is replaced with hemisphere 82. The two hemispheres 80 and 82 are joined with a shaped diaphragm 84 between them, shaped diaphragm 84 being the replacement for liquid piston 62 Shaped diaphragm 84 is constructed of suitable flexible material and is shaped so as to fit against the inner wall of hemisphere 80 or hemisphere 82 alternately as one refrigerant vapor exerts positive compressive force upon the other. In this alternative design the float controlled switches 18 and 44 are replaced by plunger switches 86 and 88. The piston liquid pipe 60 has no replacement in this alternative design. All other components of the thermally powered refrigeration system as depicted in FIG. 1 remain without change. The basic operation of the alternative compressor depicted in FIG. 3 is similar to that described for the liquid piston compressor depicted in FIG. 1 and FIG. 2 except that the shaped diaphragm moves from one hemisphere wall to the other in place of the liquid free piston moving from one cylinder to the other in response to changes in the vapor pressures exerted by the two refrigerants 64 (R22) and 66 (R12). Other designs for compressors capable of compressive action in both of two possible compressive action directions may be employed in this thermally powered refrigeration system without departing from the spirit of the invention as defined by the scope of the appended claims.

From the foregoing it should be evident that various modifications can be made to the described invention without departing from the scope of the present invention.

What is claimed is:

1. A thermally powered heat transfer system having a first and a second cycle of operation, comprising:

first and second closed loop heat transfer means each of said transfer means including respectively a first and a second refrigerant, a first and a second condenser means for transferring heat from the first and second refrigerants to a first and a second heat sink, and a first and a second heat exchanger for transferring heat from a first and a second heat source to the first and the second refrigerants;

compressor means for said first and second transfer means powered by energy derived from the first heat source for causing said second condenser means to transfer heat from the second refrigerant to the second heat sink during each first cycle of operation and powered by energy derived from the second heat source for causing said first condenser means to transfer heat from the first refrigerant to said first heat sink during each second cycle of operations; and control means for causing such system to change its cycle of operation.

2. In a thermally powered heat transfer system as defined in Claim 1 in which the first and second heat sinks are common.

3. In a thermally powered heat transfer system as defined in Claim 2 in which the compressor means has two cylinders and a free piston common to the two cylinders.

4. In a thermally powered heat transfer system as defined in Claim 3 in which the control means changes the cycle of operation when the piston reached predetermined positions in the two cylinders.

5. In a thermally powered heat transfer system as defined in Claim 2 in which the compressor comprises wall means defining a chamber and a flexible diaphragm mounted in the wall means to divide the chambers into two isolated subchambers.

6. A thermally powered heat transfer system having two cycles of operation comprising:

a first closed loop heat transfer means having a first heat exchanger, a first heat sink, a first refrigerant, and first condenser means for transferring heat from the first refrigerant to a first heat sink, said first heat exchanger transferring heat from a first heat source to the first refrigerant during each first cycle of operation and said first condenser means transferring heat from the first refrigerant to the first heat sink during each second cycle of operation;

a second closed loop heat transfer means having a second heat exchanger, a second heat sink, a second refrigerant and second condenser means for transferring heat from the second refrigerant to a second heat sink; said second heat exchanger transferring heat from a second heat source to the second refrigerant during each second cycle of operation and said second condenser means transferring heat from the second refrigerant to the second heat sink during each first cycle of operation;

compressor means powered by the first refrigerant of the first heat transfer means for compressing the second refrigerant during each first cycle and powered by the second refrigerant of the second heat transfer means for compressing the first refrigerant during each second cycle;

the temperature of the second heat source being higher than that of the first;

the boiling point at standard atmospheric pressure of the second refrigerant being higher than that of the first refrigerant;

the temperature of the heat sinks being between the temperature of the first and second heat sources; and control means including valve means for causing the system to switch from one cycle of operation to the other.

7. A thermally powered heat transfer system as defined in Claim 6 in which the temperatures of the heat sinks are substantially the same.

8. A thermally powered heat transfer system as defined in Claim 7 in which the compressor means has two cylinders and a free piston common to the two cylinders.

9. A thermally powered heat transfer system as defined in Claim 8 in which the free piston is a liquid.

10. A thermally powered heat transfer system as defined in claim 7 in which the compressor comprises wall means defining a chamber, and a flexible diaphragm mounted in the chamber, and a flexiable diaphragm mounted in the chamber dividing the chamber into two subchambers.

11. A thermally powered heat transfer system as defined in claim 10 in which the control means causes the system to change from one cycle to the other when the diaphragm reaches predetermined positions in the chamber.

12. The method of transferring heat from first and second heat sources to first and second heat sinks using a first and a second refrigerant during two cycles of operation, comprising the steps of:

A. during the first cycle of operation;

1. evaporating the first refrigerant from a first collector using heat from the first sources;
2. compressing the second refrigerant using the evaporated first refrigerant as the source of energy;
3. transferring heat from the compressed refrigerant to a second heat sink to liquify the second refrigerant;
4. collecting the liquified second refrigerant in a collector.
5. initiating a second cycle of operation when substantially all the second refrigerant available has been collected;

B. during the second cycle;

1. evaporating the second refrigerant from a second collector using heat from the second source;
2. compressing the first refrigerant using the evaporated second refrigerant as the source of energy;
3. transferring heat from the compressed first refrigerant to a first heat sink to liquify the first refrigerant;
4. collecting the liquified refrigerant in a second collector;
5. initiating the first cycle of operation when substantially all the first refrigerant available has been collected.

13. In the method of transferring heat of claim 12 in which the first and second heat sinks are at substantially the same temperature.

14. The method of removing heat from a first heat source comprising during a first cycle of operation the steps of:

evaporating a first refrigerant in a first evaporator using heat from said first heat source;

compressing a second refrigerant in a compressor powered by the first refrigerant;

condensing the second refrigerant in a second condenser $02202 by transferring heat from the second refrigerant to a second heat sink:

initiating a second cycle when substantially all the second refrigerant has been condensed;

the second cycle of operation comprising the steps of:

evaporating the condensed second refrigerant in a second evaporator using heat from a second heat source;

compressing the first refrigerant in a compressor powered by the second refrigerant;

condensing the first refrigerant in a first condenser by transferring heat from the first refrigerant to a first heat sink; and initiating the first cycle of operation when substantially all the first refrigerant has been condensed;

the temperature of the second heat source being higher than the first, the boiling point at standard atmospheric pressure of the second refrigerant being greater than the first, and the temperature of the heat sink being between the temperature of the heat sources.

* * * * *